United States Patent [19]

Cadwell et al.

[11] Patent Number: 4,984,706

[45] Date of Patent: Jan. 15, 1991

[54] HINGED CASING

[75] Inventors: Peter F. Cadwell, Sunnyvale; Noah L. Anglin, San Jose, both of Calif.

[73] Assignee: Poqet Computer Corporation, Sunnyvale, Calif.

[21] Appl. No.: 373,769

[22] Filed: Jun. 30, 1989

[51] Int. Cl.[5] ..... E05D 11/00

[52] U.S. Cl. ..... 220/334; 220/335

[58] Field of Search ..... 220/334, 335, 337, 338

[56] References Cited

U.S. PATENT DOCUMENTS

| | | | |
|---|---|---|---|
| 1,292,725 | 1/1919 | Dexter | 220/335 X |
| 2,464,524 | 3/1949 | Nathan | 220/334 X |
| 2,634,018 | 4/1953 | Mageau, Jr. | 220/334 |
| 2,702,651 | 2/1955 | Graham | 220/338 |
| 3,477,091 | 11/1969 | Gordon | 220/334 X |
| 3,833,964 | 9/1974 | Harcourt | 220/335 X |
| 4,114,236 | 9/1978 | Vandervort | 220/335 X |

*Primary Examiner*—Steven M. Pollard
*Attorney, Agent, or Firm*—Skjerven, Morrill, MacPherson, Franklin & Friel

[57] ABSTRACT

A pocket-type computer encompassed by a two-part hinged casing has a hinge structure in which a lower housing containing a computer keyboard has a pair of spaced hinge elements pin-connected to an elongated hinge element of an upper housing containing a computer display panel. An elongated small leaf spring is captured within a slot on an exterior surface of a rear wall of the lower housing so that the bowed medial portion of the spring rides on a curved cam surface at the rear bottom edge of the upper housing during opening and closing of the respective housings forming the casing. Sufficient spring force is provided by the leaf spring so that the upper housing can be rotated with respect to the lower housing to an infinite number of angular positions and when the rotation is stopped allows the housings to stay in the then fixed angular position with the compressive force and friction of the leaf spring being sufficient to overcome the force of gravity tending to close the upper housing onto the lower housing. In a preferred embodiment the frictional force is constant since the cam surface is of a constant radius of curvature.

16 Claims, 2 Drawing Sheets

HINGED CASING

FIELD OF THE INVENTION

This invention pertains to a two-part hinged casing or container having an upper and a lower housing which upon opening about the hinge enables one housing to be kept in an infinite number of angular positions with respect to the other housing. More particularly, the invention is directed to a casing for a small-sized personal computer of the pocket-type, in which a spring-loaded hinge is provided to enable a computer display panel to be viewed in any one of an infinite positions when the casing is opened to give visual access to a display panel in an upper housing and manual access to a keyboard in a lower housing.

BACKGROUND OF THE INVENTION

The most common construction of a personal computer is a stand-alone desk-type computer using magnetic disk drives. Such computers, for example, the Apple MacIntosh computer, utilize a relatively large one-piece casing and significant power. This type of construction cannot be employed in so-called lap-type computers, let alone in an extremely small pocket-type computer. Such lap-type and pocket-type computers normally utilize memory cards and other miniature electronic components. So as to accommodate a display screen lap-type and pocket-type computers have employed a two-piece or multi-piece housing or casing with an upper casing containing the display screen.

In these devices each incremental part of the internal casing inch volume is important so to accommodate the required components. For example, the Zenith Supersport 286 Model includes a multi-piece casing in which a hinged upper casing incorporates a viewing screen. A lower casing from which a computer keyboard projects includes a raised rear position and a wide rear margin which permits the upper housing to be hinge rotated only 90° from the keyboard housing. Apparently there is a friction element in the side hinges which allow the upper position to be fixed at any angular position between 0° and 90°.

Other two-part general usage containers utilize a friction-type hinge or a lock knob to keep a top half of a casing at an angular position with respect to a casing bottom half.

SUMMARY OF THE INVENTION

Figure 1:
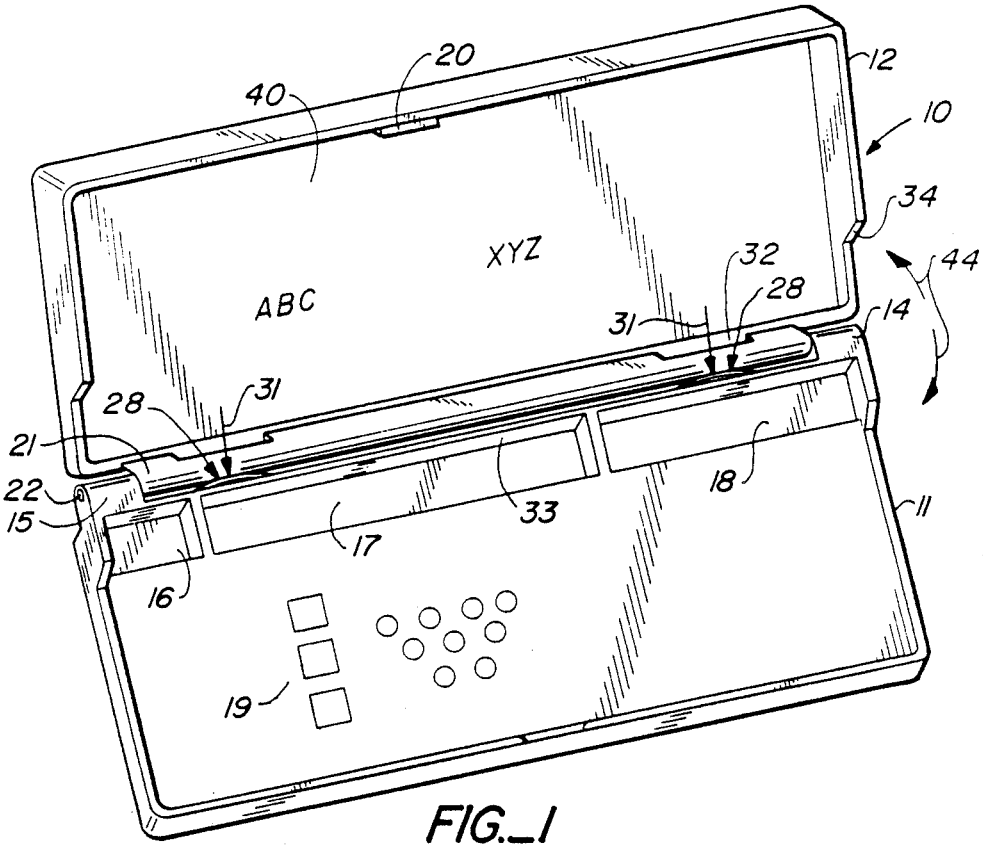
FIG. 1 is a perspective view of the two-part hinged pocket computer casing of the invention in an opened angular set position.

The hinge mechanism of the invention is incorporated into a two-part container such as a pocket-type computer casing. A generally rectangular lower housing typically containing a computer keyboard and functional electronics has a pair of spaced hinge elements and at least one elongated slot on a rear wall exterior surface. An elongated leaf spring is captured within the slot(s). A generally rectangular upper housing having essentially the same width and length as the lower housing has an integral elongated hinge element operable mounted with and pivotable with respect to the hinge elements of the lower housings. Pivot pins pass through in a force-fit in apertures in the hinge elements. The elongated hinge element of the upper housing has a transversely curved cam surface juxtaposed to the slot(s) and the leaf spring(s) so that as the casing is opened an outwardly bowed medial or central position of the leaf spring(s) ride in frictional engagement with the cam surface(s) of the upper housing sufficient to overcome the gravity force tending to drop the opened upper housing back into closed engagement with the lower housing. Thus the upper housing may be rotated with respect to the lower housing to open the overall casing to fixedly position the housings in an infinite number of angular positions with respect to each other. In a preferred embodiment the invention is utilized in a pocket-type computer where the lower housing contains a computer keyboard and associated electronics and the upper housing contains a computer display and associated driver electronics.

Resultant from the described invention is a low-cost plastic computer casing of extremely simple and compact design. A highly reliable constant-force hinge is provided with little or no need to add housing wall thickness or hinge volume and expense. The combination of one or two leaf springs captured in one housing edge in juxtaposition with complementary cam surfaces on an edge of another housing results in a constant force as the upper housing is rotated. Provision may also be made for an ever increasing or decreasing force. A long-life hinge is produced due to the constant or controlled coefficient of friction.

DETAILED DESCRIPTION

A two-part hinged container, shown in the form of a pocket-type computer casing 10, includes a lower housing 11 and an upper housing 12 hinged together by end hinges. In the preferred embodiment an overall container or casing having a length of about 22 cm, a width of 11 cm and a thickness of 2.2 cm is formed. Lower housing 11 contains a pair of hinge elements 14 and 15 one at each end of a housing rear wall 33. Lower housing 11 is of molded plastic and has rectangular recesses 16, 17 and 18 along a rear edge for respective insertion of a storage capacitor to temporarily store power while making a battery change, of two AA batteries as the computer power source, and an interconnect cable for interconnecting housings 11 and 12. A computer keyboard 19 with appropriate function keys is mounted in a horizontal position across housing 11.

Figure 5:
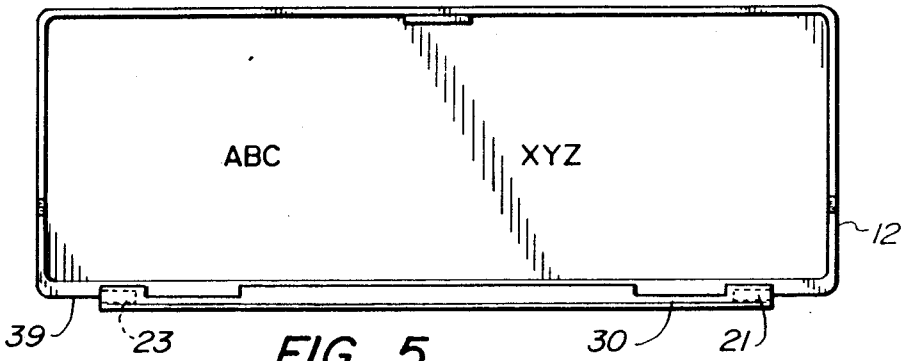
FIG. 5 is a bottom plan view of the upper housing looking at a contained display screen.
Figure 2:
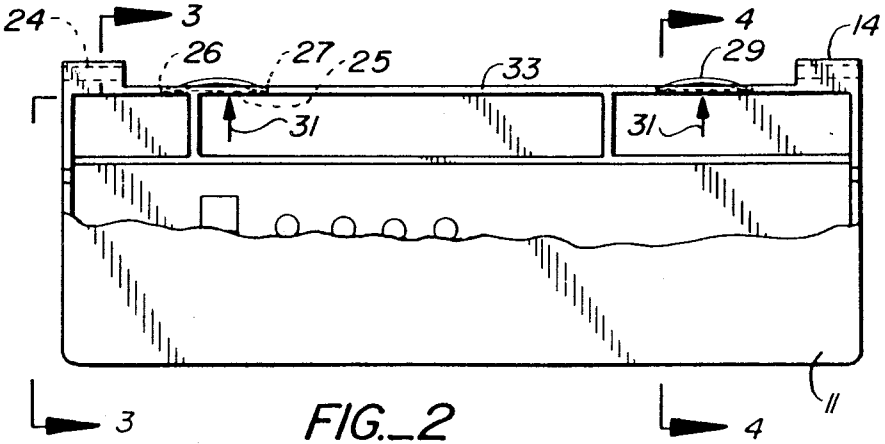
FIG. 2 is a top plan view of the lower housing containing a keyboard.

Upper housing 12 is also of molded plastic such as Lexan polycarbonate or ABS plastic (acrylonitrile-butadienestyrena) and includes a latch mechanism 20 which locks with a complementary latch plate in the lower housing in the container "closed" position. The overall details of the latch mechanism are seen in the Related Application. The upper housing includes an integral elongated hinge element 21 extending substantially lengthwise of the rear edge of the upper housing. The hinge element 21 is operably rotatively mounted by pintle pins 22, preferably drive-fit roll pins, in complementary apertures 23 and 24 (FIGS. 2 and 5) in hinge element 21 and hinge elements 14 and 15. The upper housing in the preferred pocket-type computer embodiment contains a display screen 40 with associated electronics (not shown). The rear side wall 33 of lower housing 11 contains a pair of elongated slots 25 (FIG. 2) of a length sufficient to capture the turned-up ends 26 and 27 of leaf springs 28.

Figure 7:
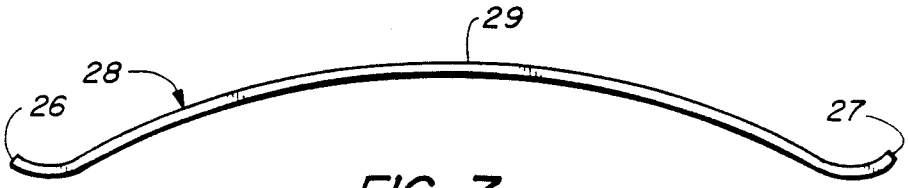
FIG. 7 is a side view of the leaf spring shown in magnified form used to friction-hold the upper housing with respect to the lower housing.
Figure 8:
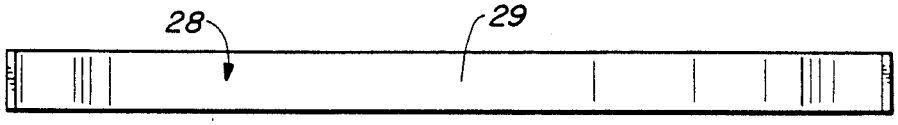
FIG. 8 is a plan view of the leaf spring.
Figure 6:
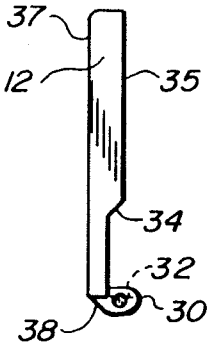
FIG. 6 is an end view of the lower housing.
Figure 3:
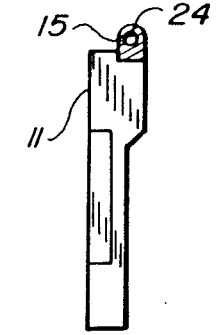
FIG. 3 is a partial cross-sectional and end view of the lower housing taken on the line 3—3 of FIG. 2.

Leaf springs 28 are typically made of carbon steel AISI-C-1095 with full temper and a 38 mm length, 4 mm width and about a 0.3 mm thickness. The springs shown in magnified detail in FIGS. 7 and 8 are insertable into the slots 25 so that medial bowed portion 29 of the springs frictionally contact and spring load normal to and tangentially of a transversely curved cam portion 30 (FIGS. 5-6) of the hinge element 21 at a locus of points adjacent to the ends of arrows 31.

The cam surfaces extend inwardly from an enclosed rear wall 38 of the upper housing. Slots 32 which are in the form of flats in the cam portion 30 extend perpendicular to the top wall 37 of housing 12 and parallel to the housing rear wall and are of sufficient length to accommodate the bowed portions of respective leaf springs when the upper and lower housings are in a "closed" condition. As the upper housing is rotated downwardly as shown by arrow 44 the medial portion of the leaf springs "riding-on" and frictional depressed by the cam action of hinge element cam portions 30, expands and snaps into slots 32 as the housings come together into a casing closed position. Cam surface 30 has a constant radius from the center of rotation (FIG. 6) and thus a constant frictional force is created the entire time the bowed portions of the leaf springs are riding on this cylindrical surface.

The hinged housing spring is loaded by the action of the bowed leaf springs in such a manner so as to create a constant friction hinge which enables a user to position a top half of the computer casing in an infinite number of angular positions in relation to the other bottom half of the computer casing. The hinge friction thus created will remain constant over a long period of time especially since the spring is relaxed when the casing halves are in a closed position. The coefficient of friction between the spring and the plastic cam surface is low ($<<1$) and will remain essentially constant. Slots 32 are faired into the cam portions 30 so that as the casing is first opened the springs slide out of the slots 32 into full frictional engagement with the cam portions 30. A somewhat higher initial force is necessary to open the casing housing(s) until the springs medial portions are riding on the curved cam surfaces 30.

The amount of frictional force between the springs and the plastic cam surface is determined by the spring force and friction coefficient and is chosen so that the upper housing will stay in position (counteracting the gravity force created by the mass of the upper housing including the computer display panel and associated electronics) and be just slightly greater than the gravity force. Higher friction would be possible but would make it harder to move the upper housing and could damage and abrade the cam surface. Cam surface may also have a gradually increasing radius of curvature which would require an ever increasing force to move the upper housing into an increasingly more open or angular position. Conversely a gradually decreasing radius of curvature may be employed.

Figure 4:
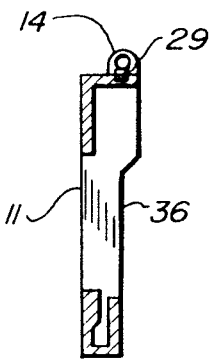
FIG. 4 is a cross-sectional view of the lower housing taken on the line 4—4 of FIG. 2.

In order to accommodate the thickness of the hinge elements a recess 34 (FIG. 6) is provided in the side walls of the upper housing so that in a closed position the higher portion 35 of the side wall nests in a lower portion 36 (FIG. 4) of the lower housing. This recess 34 and recess 39 (FIG. 5) in the upper housing rear wall will allow the upper housing to be rotated in excess of 90° from the closed position with respect to the lower housing, namely, to a position of about a 200° angular displacement.

It is contemplated that a single leaf spring may be provided to ride medially of hinge element 21 and trapped in a single slot medially juxtaposed between hinge elements 14 and 15 in the lower housing 11.

The above description of embodiments of this invention is intended to be illustrative and not limiting. Other embodiments of this invention will be obvious to those skilled in the art in view of the above disclosure.

We claim:

1. A two-piece hinged container comprising:

a lower housing having at least one hinge element and a rear side wall containing at least one elongated slot on an exterior surface thereof;

a upper housing having at least one hinge element operable mounted with and pivotable with respect to said at least one hinge element of said lower housing rear side wall, and a rear side wall having a longitudinal exterior transversely curved surface juxtaposed with respect to said elongated slot of said lower housing; and at least one elongated leaf spring having end portions captured in a respective ones of said at least one slot in said lower housing and having a central portion extending outwardly from said lower housing side wall tangent to and in friction engagement with said upper housing exterior transversely curved surface with sufficient spring force such that said upper housing and lower housing may be rotated with respect to one another about said hinge elements so as to fixedly position said housing together by friction forces in an infinite number of angular positions with respect to each other.

2. The hinged container of claim 1 in which said spring force is essentially constant over substantially 180° of angular movement of one of said housing with respect to the other.

3. The hinged container of claim 1 wherein said hinge elements include pintle-hinge elements positioned at each end of said upper and lower housing rear side walls, wherein said at least one slot is a pair of slots each juxtaposed inboard of each of said pintle-hinge elements and wherein said at least one leaf spring is a pair of leaf springs, each positioned in one of said juxtaposed slots.

4. The hinged container of claim 1 in which said at least one slot is a single slot in a medial position in said lower housing rear side wall and said at least one leaf spring is a single leaf spring trapped in said single slot.

5. The hinged container of claim 1 in which said upper housing has a flat surface juxtaposed to said curved surface, which flat surface in a closed condition of said upper and lower housings is parallel to and loaded by said leaf spring central portion such that a relatively higher initial force is necessary to move said upper and lower housing from a closed to an open condition.

6. The hinged container of claim 5 in which said flat surface is depressed in said curved surface and is essentially longitudinally coextensive with that portion of the leaf spring extending outwardly from said lower housing rear side wall.

7. The hinged container of claim 1 is which said curved surface has a constant radius of curvature.

8. The hinged container of claim 1 in which said curved surface is a cam surface of varying curvature such that variable frictional holding forces are generated dependent on the angular position of one housing with respect to the other housing in varying degrees of opening of said container.

9. The hinged container of claim 8 in which said cam surface has an increasing radius of curvature as said container is opened to a more opened position.

10. The hinged container of claim 8 in which said cam surface has a decreasing radius of curvature as said container is opened to a more opened position.

11. The hinged container of claim 1 wherein said at least one leaf spring has curved tips on opposite ends thereof, said tips being captured by vertical surfaces at the ends of said at least one slot.

12. The hinged container of claim 1 wherein said upper housing rear side wall has an inclined surface extending from a substantially flat top wall of said upper housing, and wherein said curved surface extends from a lower edge of said inclined surface more than 180° to a substantially flat interior surface of said rear side wall adjacent said top wall.

13. The hinged container of claim 12 when co-portions of said curved surface and said flat interior surface have a depressed flat slot into which said central portion of said at least one leaf spring is trapped wherein said housings are in a closed condition.

14. A two-part hinged computer casing comprising:

a lower housing containing a computer keyboard and operable computer components, said lower housing including hinge means positioned for hinging an upper housing thereto and containing a rear side wall having an elongated slot therein;

said upper housing containing a computer display screen and operative driver components, said upper housing including an elongated hinge element operably mounted with and pivotable with respect to said hinge means and having an exterior curved cam surface on said hinge element juxtaposed to said elongated slot; and an elongated leaf spring captured in said elongated slot and having a medial portion juxtaposed to and in friction contact with said cam surface, such that said upper housing may be pivotably moved with respect to said lower housing and kept by a resultant frictional force at any fixed angular open position of said housings when pivotal movement is stopped.

15. The computer casing of claim 14 in which said upper housing includes a pair of side walls, each of said side walls having a recess adjacent a rear wall of said upper housing which permits pivoting action of said upper housing around said lower housing hinge means such that said upper housing may be rotated more than 90° with respect to said lower housing.

16. The computer casing of claim 15 in which said hinge means extends outwardly from said rear side wall and said cam surface extends inwardly from a bottom edge of an inclined rear wall of said upper housing.

* * * * *